United States Patent [19]

Isobe

[11] 4,113,750

[45] Sep. 12, 1978

[54] PACK FOR ENDLESS INK RIBBON CARTRIDGE

[75] Inventor: Minoru Isobe, Tokyo, Japan

[73] Assignee: Oki Electric Industry Co., Ltd., Tokyo, Japan

[21] Appl. No.: 691,200

[22] Filed: May 28, 1976

[51] Int. Cl.[2] ..... B65D 85/67

[52] U.S. Cl. ..... 206/388; 206/389; 206/39.5; 400/196

[58] Field of Search ..... 206/389, 387, 392, 442, 206/83.5, 39.5, 388; 197/168

[56] References Cited

U.S. PATENT DOCUMENTS 3,355,010 11/1967 Harrison ..... 206/497

FOREIGN PATENT DOCUMENTS 1,416,802 7/1973 United Kingdom ..... 197/168

OTHER PUBLICATIONS

IBM Technical Disclosure Bulletin, vol. 17, No. 5 Oct. 1974.

*Primary Examiner*—William Price
*Assistant Examiner*—Joseph M. Moy
*Attorney, Agent, or Firm*—Peter L. Berger

[57] ABSTRACT

A pack for an endless ink ribbon cartridge for high speed printer enabling easy loading and replacement of endless ink ribbon.

2 Claims, 11 Drawing Figures

PACK FOR ENDLESS INK RIBBON CARTRIDGE

BACKGROUND OF THE INVENTION

A speed increase in the central processing unit of a computer requires a correspondingly elevated speed in the terminal high speed printer.

This will in turn result in a requirement for a higher speed for the feeding of ink ribbon necessary for printing in such high speed printer. Such ink ribbon feed is typically realized by means of a cartridge as shown in FIG. 1 wherein an endless ink ribbon is accomodated in a folded and stacked state. Said cartridge is composed of a casing 2 of a thickness comparable to the width of said endless ink ribbon 1, is provided with a curved portion 3 on the upper part thereof and an inlet slit 5 and outlet slit 4 for said ink ribbon on both sides of said curved portion and is further provided internally with curved surfaces at the sides and at the corners thereof in order to facilitate the displacement of said ink ribbon in folded state. Further inside said inlet slit there is provided a pair of ink ribbon intake rollers 6, 7 which hold the ink ribbon there between whereby said endless ink ribbon 1 is fed from the outlet slit 4 and pulled into said cartridge by means of the rotation of said roller 6.

Such cartridge in which the endless ink ribbon accomodated therein in folded state is continuously advanced in a direction by means of said feed rollers, is advantageous in the simple drive mechanism thereof but is associated with a difficulty to load a new endless ink ribbon which tends to spread out and cannot be easily accommodated in a neatly folded and stacked state.

OUTLINE OF THE INVENTION

The present invention relates to a pack for an endless ink ribbon cartridge consisting of a casing open in one side thereof of a form capable of fitting into the ink ribbon accomodating chamber of said cartridge and containing an endless ink ribbon in folded and stacked state, said pack being adapted to be inserted with the ink ribbon contained therein into said ink ribbon cartridge and then being alone extracted therefrom thereby transferring said ink ribbon into the casing of said cartridge.

OBJECT OF THE INVENTION

The first object of the present invention is to facilitate the replacement of the ink ribbon in an endless ink ribbon cartridge (hereinafter simply referred to as cartridge).

The second object of the present invention is to provide a means for enabling the loading of an endless ink ribbon into such cartridge in a folded and stacked state.

The third object of the present invention is to provide a pack containing an endless ink ribbon in already folded and stacked state and to utilize such pack for loading said ink ribbon into the cartridge.

DETAILED DESCRIPTION OF THE INVENTION

Figure 1:
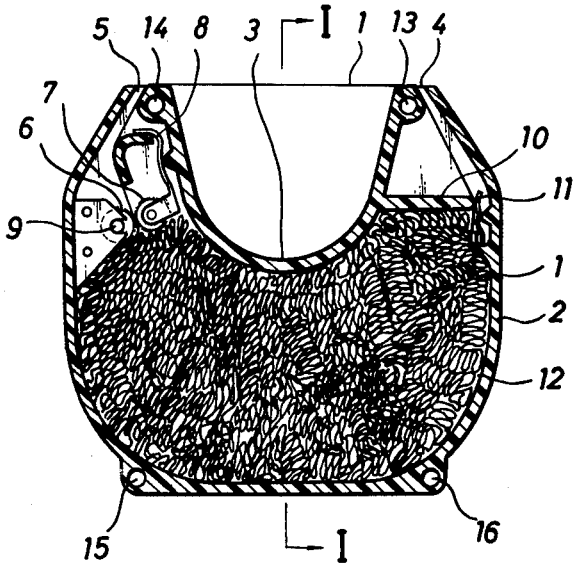
FIG. 1 PRIOR ART
FIG. 1 is a plan view of a cartridge with the lid thereof removed.
Figure 2:
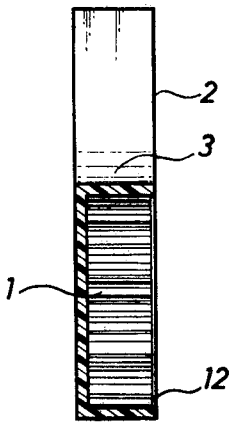
FIG. 2 PRIOR ART
FIG. 2 is a cross sectional view along the line I — I in FIG. 1.
Figure 3:
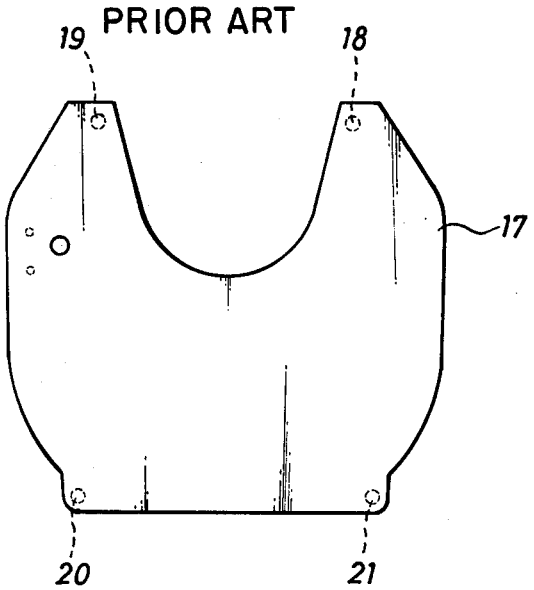
FIG. 3 PRIOR ART
FIG. 3 is a plan view of the lid of cartridge.
Figure 4:
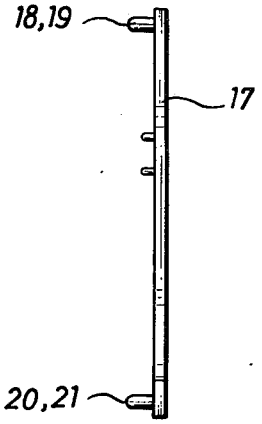
FIG. 4 PRIOR ART
FIG. 4 is a lateral view of said lid.
Figure 5:
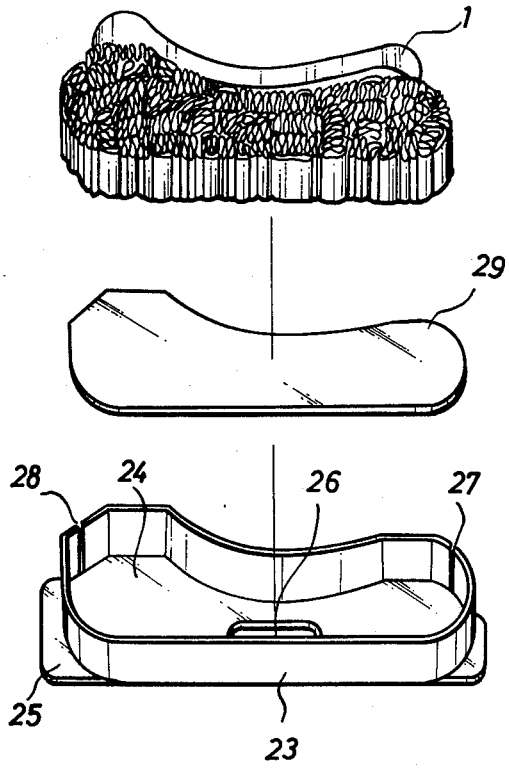
FIG. 5 is an exploded perspective view indicating the casing, a pushing plate and the endless ink ribbon.
Figure 6:
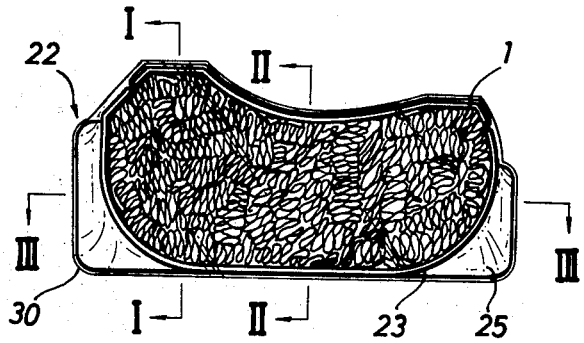
FIG. 6 is a plan view of said pack.
Figure 7:
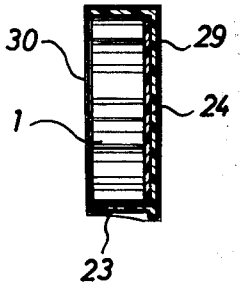
FIG. 7 is a cross sectional view along the line I — I in FIG. 6.
Figure 8:
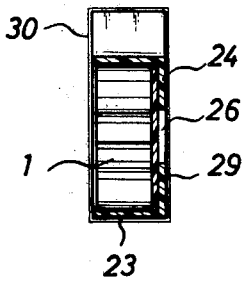
FIG. 8 is a cross sectional view along the line II — II in FIG. 6.
Figure 9:
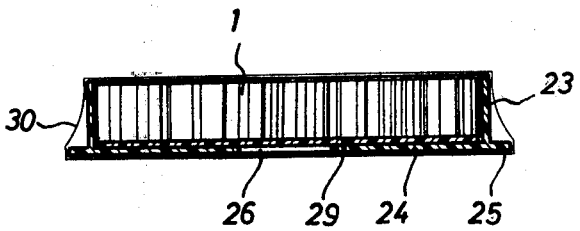
FIG. 9 is a cross sectional view along the line III — III in FIG. 6.

Preferring to FIGS. 1, 2, 3 and 4 there is shown a conventional cartridge consisting of a casing and a lid. Said casing 2 is composed of a box of plastic material which is open on one side thereof and is provided with an internal width approximately equal to that of the endless ink ribbon 1. Said casing is provided with a concave curved portion 3 at the upper part thereof and with an outlet slit 4 and an inlet slit 5 for said ink ribbon on both sides of said concave curved portion 3 so as that said ink ribbon can traverse said concave curved portion. Inside said inlet slit 5 there is provided a pair of feed rollers 6, 7, the latter of which is pressed against the former by means of a spring 8. Further, the shaft 9 of said roller 6 is connected to a rotary driving mechanism.

Also inside said outlet slit 4 there is provided a guide projection 10 which is maintained in contact with a spring 11.

The chamber 12 for accommodating the endless ink ribbon 1 is provided with curved surfaces at the sides and corners thereof in order to facilitate the displacement of the endless ink ribbon contained therein in a folded end stacked state from the inlet slit to the outlet slit. In this manner the endless ribbon 1 is supplied from said outlet slit 4 after passing between said guide projection 10 and said spring 11, then enters said inlet slit 5 and returned to said accommodating chamber 12 by means of said feed rollers 6, 7.

In the drawing the numbers 13, 14, 15 and 16 indicated holes for engaging with said lid 17.

Said lid 17 is made of a plastic material of a shape corresponding to the external shape of said casing 2 and is internally provided with engaging projections 18, 19, 20 and 21 which respectively engage with said engaging holes 13, 14, 15 and 16 of the casing 2 thereby fixing said lid thereto.

The cartridge thus structured performs the taking up of the endless ink ribbon 1 by means of a pair of feed roller 6, 7 rotated by the shaft 9 connected with a rotary drive mechanism, said ink ribbon being stored therein in a folded and stacked state and gradually displaced toward the outlet slit 4.

According to the present invention, the pack for loading the endless ink ribbon into the casing 2 of the cartridge as explained above is composed of a plastic case 23 with one open side which is provided with an internal width approximately equal to the width of said endless ink ribbon 1 and with an external shape substantially corresponding to that of said accomodating chamber 12 of said casing 2 so as that said case 23 can be fitted into said accomodating chamber 12.

The closing plate 24 on the opposite side is extended to form a projecting brim part, and is provided in the middle thereof with a pushing hole 26 of a size allowing insert a finger to be inserted.

Further, said case 23 is provided with slits 27, 28 on both sides in the upper portion thereof for exposing a part of the endless ink ribbon 1.

Also there is provided a separate pushing plate 29 of a plastic material of a shape substantially corresponding to the internal shape of said case 23 so as to be accommodated therein.

Said pushing plate 29 is placed in said case 23, and an endless ink ribbon 1 is then accomodated therein in a folded and stacked state with a part thereof exposed from said slits 27, 28. The case 23 is then packed with a relatively easily breakable packaging material such as a plastic film or cellophane thereby providing a completed pack 22.

Figure 10:
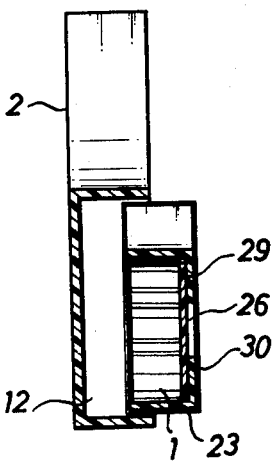
FIG. 10 is a lateral cross sectional view indicating a state wherein the pack is inserted into the cartridge.
Figure 11:
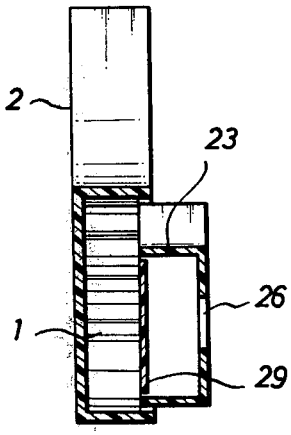
FIG. 11 is a lateral cross sectional view indicating a state wherein the pack is extracted from the cartridge, leaving the endless ink ribbon in said cartridge.

The procedure of loading said endless ink ribbon into the accommodating chamber 12 of the cartridge is explained in the following. The endless ink ribbon pack is inserted into said accommodating chamber 12 of the cartridge as shown in FIGS. 10 and 11. Then the packaging material 30 is removed, and one of the legs of exposed portion of endless ink ribbon 1 is inserted between the feed rollers 6, 7 while the other is placed between the spring 11 and guide projection 10. Then the case 23 alone is extracted from the accomodating chamber 12 by pulling aforementioned brim portion 25 while the pushing plate 29 is pressed by a finger inserted through the pushing hole 26, thereby leaving the endless ink ribbon 1 and pushing plate 29 in said accomodating chamber 12. Finally the procedure is completed by removing the pushing plate 29 and replacing the lid 17.

In this manner the endless ink ribbon 1 is maintained in the folded and stacked state by means of the packaging material 30 and becomes exposed by the breakage thereof only after the pack is inserted into the accomodating chamber 12 of the casing 2, and such folded and stacked state is not broken as the endless ink ribbon is pushed out in such state in the loading procedure.

As detailedly explained in the foregoing, the pack for endless ink ribbon of the present invention enables assured loading operation while maintaining the endless ink ribbon in folded and stacked state by means of a pushing plate and a packaging material.

What we claim is:

1. A pack comprising a case housing an endless ink ribbon in a folded and stacked state therein for use with an endless ink ribbon cartridge having a chamber for housing an endless ribbon for use with a printing means, said case being formed of a rigid material and having a shape and size substantially similar to said chamber, said case comprising an upstanding wall having slits therein for passing a part of said endless ink ribbon to form a strip upon which initial printing will occur, removable packaging material enclosing said case for maintaining said folded and stacked ink ribbon in said case while said pack is inserted in said chamber, pushing place locating inside said case for ejecting said folded and stacked ribbon from said case and pushing said ribbon into said chamber, said packaging material being removed prior to said ink ribbon being inserted into said chamber.

2. A pack for an endless ink ribbon cartridge holding an endless ink ribbon, said cartridge having an accommodating chamber to hold said endless ink ribbon, said pack comprising a flat case with one open side of a shape substantially corresponding to that of said accomodating chamber in said cartridge so as to be fitted into said accomodating chamber, said case being provided at the opposite side with a closing plate extended to form a brim portion and having a pushing hole therein and further provided with slits on both sides at the upper part of said case for passing a part of said endless ink ribbon, an endless ink ribbon contained in said case in a folded and stacked state, a pushing plate located inside said closing plate of said case for pushing said endless ribbon in stacked state uniformly in the width direction thereof, and a packaging material for maintaining said pushing plate and said endless ink ribbon in said case, said packaging material being removed prior to said folded and stacked ink ribbon being inserted in said chamber.

* * * * *

UNITED STATES PATENT AND TRADEMARK OFFICE

CERTIFICATE OF CORRECTION

PATENT NO. : 4,113,750

DATED : September 12, 1978

INVENTOR(S) : Minoru Isobe

It is certified that error appears in the above–identified patent and that said Letters Patent are hereby corrected as shown below:

Column 1, line 12, after "1" insert --,--.

Column 2, line 15, delete "Preferring" and insert --Referring--.

Column 2, line 38, delete "end" and insert --and--.

Column 2, line 45, delete "cated" and insert --cate--.

Column 4, line 16, delete "place" and insert --plate--.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*